United States Patent [19]

Fujii

[11] 4,106,299

[45] Aug. 15, 1978

[54] METHOD FOR INSTALLATION OF GROUNDING POLE

[76] Inventor: Masami Fujii, 3294-2 Oaza Ota, Hazaki-machi, Kashima-gun, Ibaragi-ken, Japan

[21] Appl. No.: 747,128

[22] Filed: Dec. 3, 1976

[30] Foreign Application Priority Data

Jun. 18, 1976 [JP] Japan ..... 51-071723

[51] Int. Cl.[2] ..... E02B 1/00

[52] U.S. Cl. ..... 61/63; 61/53.5; 174/6

[58] Field of Search ..... 174/6, 7; 175/21; 61/53, 53.5, 63

[56] References Cited

U.S. PATENT DOCUMENTS

| | | | |
|---|---|---|---|
| 642,169 | 1/1900 | Stokes | 174/7 |
| 736,411 | 8/1903 | Leonard | 174/6 X |
| 955,729 | 4/1910 | Welsh | 175/21 X |
| 1,978,440 | 10/1934 | Shepard | 174/7 X |
| 2,157,180 | 5/1939 | Little | 174/6 X |
| 3,458,643 | 7/1969 | Dorr | 174/6 |
| 3,629,485 | 12/1971 | Watanabe | 174/7 |
| 3,688,014 | 8/1972 | Yersteeg | 174/7 |

*Primary Examiner*—Dennis L. Taylor
*Attorney, Agent, or Firm*—William Anthony Drucker

[57] ABSTRACT

A method for installation of a grounding pole by boring in advance a hole with a desired depth into the earth, fitting a tip end of a grounding pole with a length almost equal to the depth of the hole to a guide tube and inserting the grounding pole with the guide tube faced down into the hole.

8 Claims, 5 Drawing Figures

METHOD FOR INSTALLATION OF GROUNDING POLE

BACKGROUND OF THE INVENTION

Conventionally, since the grounding poles have been buried into the earth, especially into the earth with poor conductivity such as a sandy soil and a rocky stratum without taking into consideration the material of the grounding pole, length of the pole, necessity of a connector for the grounding pole and others, it has been difficult to maintain the initial grounding resistance for a long period of time due to rust of the connected part, corrosion of the grounding pole. When a momentary large current such as lightning current flows into the grounding pole which employs iron, the impedance becomes large and the resistance also becomes large due to rust on the grounding pole and therefore it will be impossible to discharge such large current into the earth in safety. In other words, the protection relays have been burnt, safety communication lines have been discontinued and precision machines have been burnt, thus the protection and maintenance of electric circuits have been greatly affected.

SUMMARY OF THE INVENTION

The first object of the present invention is to provide a method for installation of a grounding pole suitable for the earth with poor conductivity such as a sandy soil and a rocky stratum.

The second object of the present invention is to provide a method for effective insertion of the grounding pole into a hole which is bored in advance by a boring machine.

The third object of the present invention is to provide a method for installation of the grounding pole of which the grounding resistance will not increase for a long period of time.

The fourth object of the present invention is to provide a method for effective installation of the grounding pole to a depth of 110 to 200m in the earth.

Other objects of the present invention are disclosed in the following description.

The present invention provides a method for installation of the grounding pole by boring a hole of desired depth in the earth with a boring machine, fitting an end of the grounding pole with the length almost equal to the depth of the above hole to the guide tube and inserting the grounding pole with the guide tube leading into the hole.

PREFERRED EMBODIMENTS OF THE INVENTION

Figure 1:
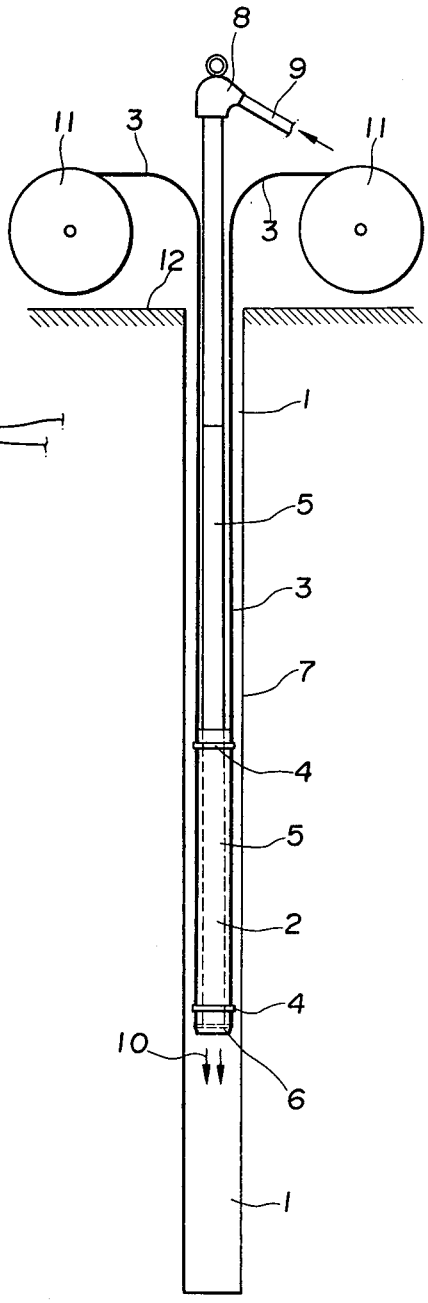
FIG. 1 shows the grounding pole and the guide tube which are inserted into the hole.

Referring to FIG. 1, there is shown a hole 1 which is bored to a desired depth by the boring machine. The guide tube 2 and the grounding pole 3 are inserted into the hole 1 while an end of the grounding pole 3 is fixed to the guide tube 2. The guide tube 2 is made hollow, the insertion tube 5 is inserted into this hollow and the stopper 6 is provided at the tip end of the guide tube 2 to stop up the insertion tube 5. When the earth on the wall 7 of the hole 1 decays and insertion of the insertion tube 5 is difficult, a pipe 9 is to be attached with a swivel joint 8 to the upper end of the hollow insertion tube 5 and water is to be supplied under pressure into the hole 1 through the pipe 9 by a pump. Then the water is jetted out from the tip end of the guide tube 2 as shown with the arrow mark 10 to cause decayed soil in the hole to float and remove it and therefore the guide tube 2 can be smoothly inserted into the hole. The length of the guide tube 2 is preferably 1 to 15m and an end of the grounding pole 3 is preferably fixed to or hooked on the outer wall of the guide tube 2. When the grounding pole 3 is inserted into the hole 1 together with the guide tube 2, it is delivered from, for example, a drum 11 around which the grounding pole 3 is wound. When the lower end of the guide tube 2 reaches the bottom of the hole 1 or a desired depth in the hole 1, the grounding pole 3 is cut at a position near the surface of earth. The grounding pole 3 is preferably made of copper for excellent electrical conduction and less emergence of rust. The guide tube 2 is made of such base metals as, most preferably, iron and, preferably, copper or preferably made of zinc-plated iron or copper. When the above grounding pole 3 and the guide tube 2 are used, a battery is formed between copper and plated zinc or between copper and iron to cause the grounding pole 3 made of copper to be rust preventive and therefore the grounding resistance of the grounding pole 3 will not increase for many years.

Figure 2:
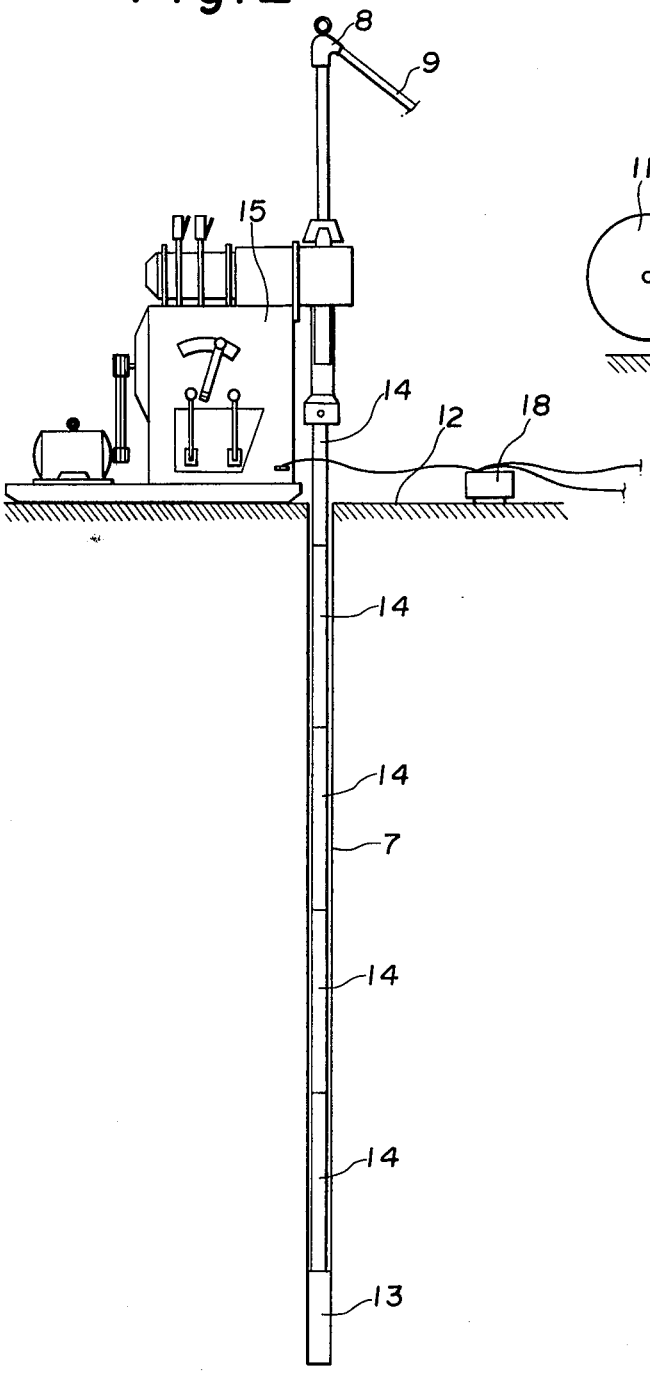
FIG. 2 shows the boring machine to be used for boring the hole.
Figure 3:
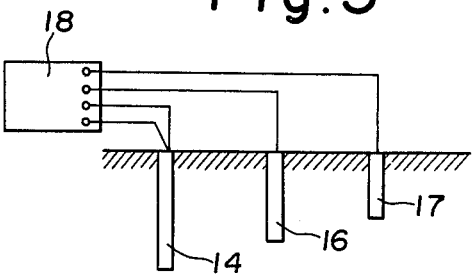
FIG. 3 shows the measurement of contact resistance directly read on the grounding resistance ohmmeter.

The hole 1 is bored as shown in FIG. 2 by the boring machine 15 with a bit 13 and an excavating rod 14. To exactly check whether the boring should be continued or stopped, the boring should be carried out while measuring the contact resistance between the excavating rod 14 and the hole wall 7. This contact resistance is obtained by measuring it on the direct reading grounding resistance ohmmeter 18 through auxiliary poles 16 and 17 driven into a ground with a suitable distance from the excavating rod 14 as shown in FIG. 3 or by measuring the current and voltage in the voltage dropping method and calculating the value with the equation of $R=V/I$.

The contact resistance between the excavating rod 14 and the hole wall 7 is measured through the excavating water supplied under pressure from the pipe 9 into the hole 1 by the pump and this measurement of the contact resistance is recommended to be done for convenience by stopping the boring machine and the pump each time the excavating rod advances 1 to 3m in the hole. When the above contact resistance is equal to or less than the target value, the boring machine is stopped, the excavating rod 14 and the bit 13 are drawn out from the hole 1, and the grounding pole 3 and the guide tube 2 are inserted into the hole 1 with the insertion tube 5 as described in the foregoing.

In some cases, it is necessary to measure the contact resistance between the excavating rod 14 and the hole wall 7 while the boring is proceeded to the depth of 100 to 200m. In these cases, the location where the auxiliary poles 16 and 17 are driven into the earth should be far remote from the excavating rod 14; otherwise accurate measurement cannot be performed. The following describes the measuring method for the contact resistance or grounding resistance in this case.

Figure 4:
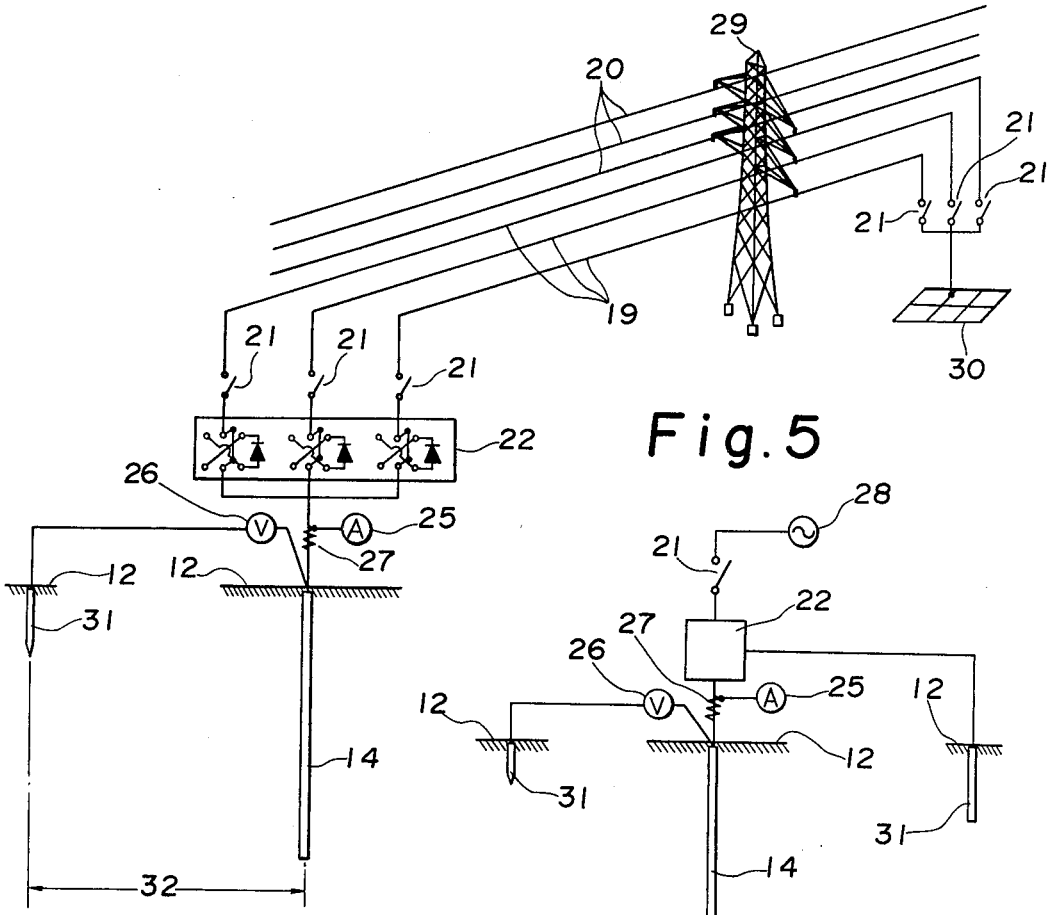
FIG. 4 shows an example of the measurement of the contact resistance between the excavating rod and the earth during the boring down to 100 to 200m.

When one of two power transmission lines 19 and 20 which are supported by the tower 29 as shown in FIG. 4 is not used, an induced voltage is produced in the power transmission line 19. This inductive voltage is converted into the direct current by a rectifier and, when the excavating rod 14 and the auxiliary pole 30 are connected electrically by closing the switch 21, the direct current flows. The current value is read on the ammeter 25 through the current transformer 27 and, at the same time, the voltage across the auxiliary pole 31 installed at a distance 32 (as shown in FIG. 4) from the excavating rod 14 and the excavating rod 14 is read on the voltmeter 26 with high internal resistance. Then the contact resistance or the grounding resistance can be obtained by substituting the above current value and voltage value in the equation $R=V/I$. When the induced voltage affects the excavating rod 14 or the auxiliary poles 30 and 31, the rectifier 22 is changed over to reverse the polarity of current supplied to the excavating rod 14, the grounding resistance is obtained by measuring said current value and the voltage value and the mean value of the grounding resistance for the polarities of forward and reverse currents is used as the grounding resistance without error. Generally, since the direct current is obtained by half-wave rectifying the three-phase alternating current, the waveform of current shows less pulsation, the indication has less error owing to the inertia of the indicator and there is less error due to the effect of polarization resulting from supplying of a large current.

Figure 5:
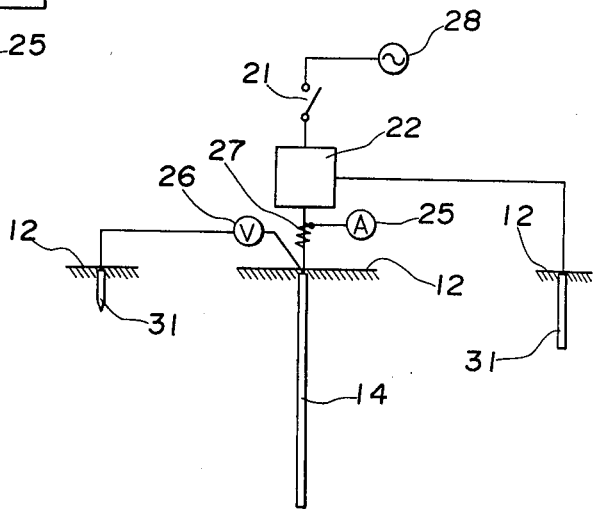
FIG. 5 shows another example of the measurement shown in FIG. 4.

As shown in FIG. 5, the above measurement may be carried out with the current supplied from the three-phase power supply 28 or with the DC generator for welding as the power supply. When the DC generator is used, the rectifier 22 is removed and the measurement can be easily performed by changing the positive and negative polarities at the power supply side.

As known from the above detailed description, the present invention permits extremely effective installation of the grounding pole in such earth where low grounding resistance is difficult to obtain from the conventional methods as a sandy soil and rocky stratum. The grounding pole installed in accordance with the method of the present invention has sufficient rust preventive effect and therefore the grounding pole will not be corroded and the grounding resistance will not increase with lapse of a long period of time.

When the lower end of the grounding pole is buried underground to the depth of 10 to 200m, the installation of the grounding pole can be effectively carried out.

What is claimed is:

1. A method, for installation of a grounding pole in the earth, which comprises the steps of:

(a) boring a hole in the earth to a desired depth (b) securing an end of at least one grounding pole, having a length substantially equal to the depth of said hole, to a guide member, (c) inserting said grounding pole and said guide member fully into the hole with the guide member leading, (d) measuring contact resistance between the earth and a boring machine during boring operation, and terminating said boring when the contact resistance is not greater than a desired target value.

2. The method claimed in claim 1 wherein the contact resistance between the boring rod and the earth is measured through water used for excavation of the hole.

3. The method claimed in claim 1 wherein a succession of measurements of contact resistance is made by stopping the operation of the boring machine after each successive advance of the excavating rod by 1 to 3 meters.

4. A method, for installation of a grounding pole in the earth, which comprises the steps of:

(i) boring a first portion of a hole in the earth utilising a boring machine having an excavating rod, (ii) applying a D.C. voltage, with a first direction of polarity, to a circuit including said excavating rod and a first remote auxiliary ground contacting element and the earth, and measuring the current flowing in said circuit, (iii) measuring the voltage present between said excavating rod and a second remote auxiliary ground contacting element, (iv) calculating by Ohms' Law a first resistance value from said current and said voltage (v) repeating the current and voltage measuring steps with the polarity of the D.C. voltage reversed, and calculating by Ohms' Law a second resistance value, (vi) calculating from said first and second resistance values a mean contact resistance value (vii) terminating boring of the hole when said contact resistance value is not greater than a desired target value, and (viii) inserting a grounding pole in said hole.

5. The method claimed in claim 4, wherein the boring is made in a plurality of successive boring operations, and steps (ii), (iii), (iv), (v) and (vi) are carried out in respective intervals between boring operations.

6. The method claimed in claim 4, wherein the D.C. voltage is obtained by rectification of three-phase alternating current.

7. The method claimed in claim 6, wherein the three-phase alternating current is obtained in three power transmission lines by induction from three other power transmission lines carrying three-phase alternating current.

8. The method claimed in claim 4, wherein the D.C. voltage is obtained from a D.C. generator.

* * * * *